US006519883B2

(12) United States Patent
Martorella

(10) Patent No.: US 6,519,883 B2
(45) Date of Patent: Feb. 18, 2003

(54) DESKTOP ORGANIZER

(76) Inventor: Rudolph Martorella, 2 Spruce St., Apt. 4A, Great Neck, NY (US) 11021

( * ) Notice: Subject to any disclaimer, the term of this patent is extended or adjusted under 35 U.S.C. 154(b) by 0 days.

(21) Appl. No.: 09/970,633

(22) Filed: Oct. 4, 2001

(65) Prior Publication Data

US 2002/0017043 A1 Feb. 14, 2002

Related U.S. Application Data

(63) Continuation-in-part of application No. 09/735,036, filed on Dec. 12, 2000, now Pat. No. 6,401,371, which is a continuation-in-part of application No. 09/620,514, filed on Jul. 20, 2000, now abandoned.

(51) Int. Cl.[7] ..... B43M 17/00; A47G 1/06

(52) U.S. Cl. ..... 40/358; 40/725; 211/85.11; 248/902

(58) Field of Search ..... 40/358, 725; 211/69.1, 211/85.1, 85.31, 181.1; 248/153, 175, 902; D6/301, 313, 462; D19/77, 81

(56) References Cited

U.S. PATENT DOCUMENTS

| | | | | |
|---|---|---|---|---|
| 1,579,978 | A | 4/1926 | Vincia | |
| D152,254 | S | 1/1949 | Gallo | |
| 2,914,185 | A | 11/1959 | LeVay | |
| 3,550,890 | A | 12/1970 | Kemp | |
| 4,768,298 | A | 9/1988 | Polhemus et al. | |
| 5,593,045 | A | 1/1997 | Eldon | |
| 5,735,075 | A | 4/1998 | Honkawa et al. | |
| D406,958 | S | 3/1999 | Baldwin et al. | |
| D417,566 | S | 12/1999 | Baldwin et al. | |
| D440,400 | S | 4/2001 | Baldwin et al. | |
| D446,247 | S | 8/2001 | Martorella | D19/77 |
| 6,401,371 | B2 | 6/2002 | Martorella | |

FOREIGN PATENT DOCUMENTS

| | | |
|---|---|---|
| GB | 817019 | 7/1959 |

*Primary Examiner*—Brian K. Green
(74) *Attorney, Agent, or Firm*—Collard & Roe, P.C.

(57) ABSTRACT

A desktop organizer that is made from a wire frame. The wire frame is shaped to hold a pair of eyeglasses, a container for holding paperclips and thumb tacks and at least two other containers for holding elongated objects such as pens, pencils, emery boards and scissors. There is also a holder for business cards and a holder for a picture frame formed from this wire frame.

6 Claims, 3 Drawing Sheets

DESKTOP ORGANIZER

CROSS REFERENCE TO RELATED APPLICATIONS

This application is a continuation in part of U.S. patent application Ser. No. 09/735,036 filed on Dec. 12, 2000, now U.S. Pat. No. 6,401,371, which is a continuation in part of U.S. patent applicatior Ser. No. 09/620,514 filed on Jul. 20, 2000, now abandoned, incorporated herein by reference wherein benefit is claimed from both applications under 35 U.S.C. §120.

BACKGROUND OF THE INVENTION

Field of the Invention

The invention relates to a desktop organizer that is made from a wire frame. In addition this organizer has a clip that has a shaped region which receives a medallion.

SUMMARY OF THE INVENTION

This invention relates to a desktop organizer that stores eyeglasses when they are not being used. Essentially, this organizer contains a clip and a wire frame wherein a bridge section of the eyeglasses snaps into the clip. In addition the remaining portion of the wire frame is used to hold the arms of the eyeglasses in place so that the eyeglasses rest in the organizer.

This organizer also has a wire frame section for holding a picture frame, at least one container, and a metal clip. This wire frame section includes a base region that is shaped substantially rectangular and allows the structure to stand substantially upright when in use.

The picture frame support is formed by two parallel spaced bars extending up vertically from the base. Next, a substantially U-shaped-set of bars are coupled to these parallel spaced bars wherein these U-shaped bars comprise two sets of bars coupled to each other and spaced apart from each other in a parallel manner. A top portion of these U-shaped bars bows out to receive a transparent picture frame which holds pictures. There is also a stopper bar coupled to a bottom portion of these U-shaped bars so that the picture frame does not slide through these bars. This stopper bar is U-shaped and extends horizontally out in front of a top region of the vertically extending bars. This stopper bar also forms a business card or credit card holder in the organizer.

The picture frame can be in the form of two separate plastic sheets that are put together and then held within these parallel spaced bars supporting the picture frame.

This organizer also contains three containers for holding materials. The first container is disposed in a front-center region of the organizer, in front of the picture frame support. This first container is supported by a container holder that is formed by two semi-circular wire sections extending out horizontally one on top of the other. Both of these sections extend out from the two parallel spaced, vertically extending bars. The second or upper semi-circular wire section extends out from the stopper bar on the picture frame support. Essentially, a storage container can then slide inside of the second semi-circular wire section and rest on top of the first semi-circular wire section. This storage container can be in the form of a semi-circular shaped cup that can contain a divider disposed therein.

There are also two more containers and container holders disposed on this organizer. The second and third container holders extend out from the sides of the organizer.

Essentially, extending up from both sides of a bottom section of the base are U-shaped bars that extend up substantially vertically. These bars allow a plurality of semi-circular shaped bars to extend out horizontally therefrom. A plurality of containers can fit inside of these bars wherein a plurality of pens, pencils, emery boards, knives, rulers, scissors or any other elongated object can be placed substantially vertical inside of these semi-circular bars.

These bars wrap around these substantially elongated, vertically extending objects so that these objects will remain stationary inside of this enclosure.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
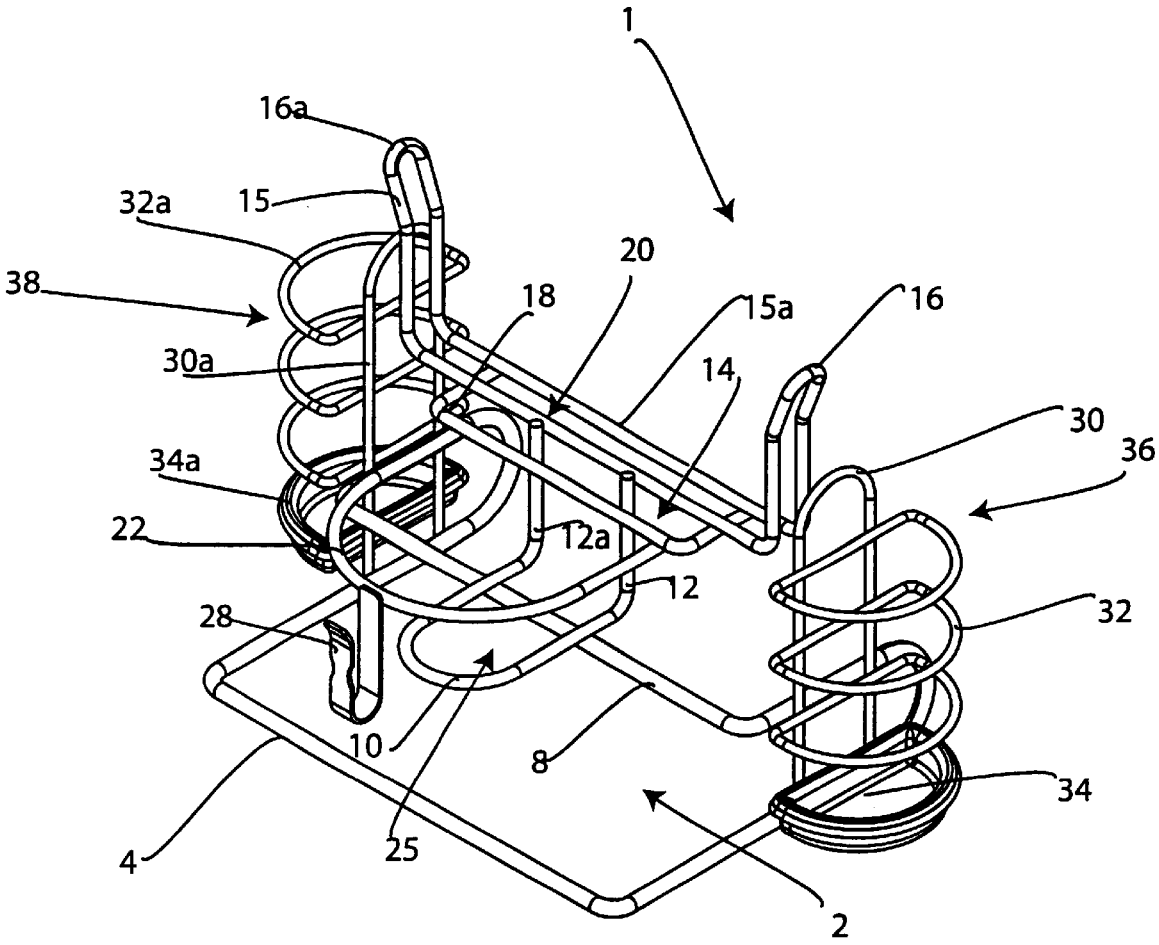
FIG. 1 is a side perspective view of the invention.

Referring in detail to the drawings, FIG. 1 shows a side perspective view of a desktop organizer 1. Organizer 1 contains a base 2 which is comprised of three wire sections 4, 6 and 8. The first wire section 4, is substantially U-shaped and extends along a substantially horizontal surface. The second wire section that consists of two U-shaped pieces 6 and 6*a* coupled to and extending up from this first wire section 4. There is a third wire section 8 which is also U-shaped and extends out substantially horizontal from second wire sections 6 and 6*a*.

Coupled to third wire section 8 on base 2 is a substantially U-shaped or semi-circular shaped wire section 10 that extends horizontally. This wire section 10 forms a bottom holder for a centrally located container. Coupled to wire section 10 are a pair of parallel spaced vertically extending bars 12 and 12*a*. Bars 12 and 12*a* are used to support a picture frame holder 14 which comprises a wire frame that is formed as two parallel spaced U-sections. 15 spaced apart to receive a picture frame. At a top region of support 14 are bowed out sections 16 and 16*a* which are shaped to receive the picture frame more easily.

Extending out from picture frame support 14 is a base bar 18 which is substantially U-shaped and is connected to a bottom region of support 14 to stop a picture frame from sliding through support 14. In addition, this base bar 18 is shaped so as to form a business card holder 20 which is bounded by base bar 18, vertically extending bars 12 and 12*a* and horizontally extending U-shaped section 10.

Coupled to base bar 18 is a substantially semi-circular shaped bar or section 22 that extends out horizontally from base bar 18 forming a container holder 25 with U-shaped section 10. Because U-shaped section 10 is disposed below semi-circular shaped section 22 and is designed smaller (See FIG. 2A) with a tighter radius than section 22, this U-shaped section supports the container while a container rests inside of section 22.

A substantially U-shaped clip 28 is coupled to a front section of semi-circular shaped section 22 wherein this clip contains two notches cut out so as to support a medallion coupled thereto.

Two vertically extending U-shaped bars 30 and 30A are coupled to wire sections 4 and 8 of base 2 and extend up an outside of base 2. These U-shaped bars 30 and 30A support a plurality of semi-circular wire frames 32 and 32A which extend out to a side of organizer 1. As shown in FIG. 2B, these frames 32 and 32A can be used to support at least one container 34 and 34A in frames 32 and 32A forming a second 36 and third 38 set of container holders.

Figure 2A:
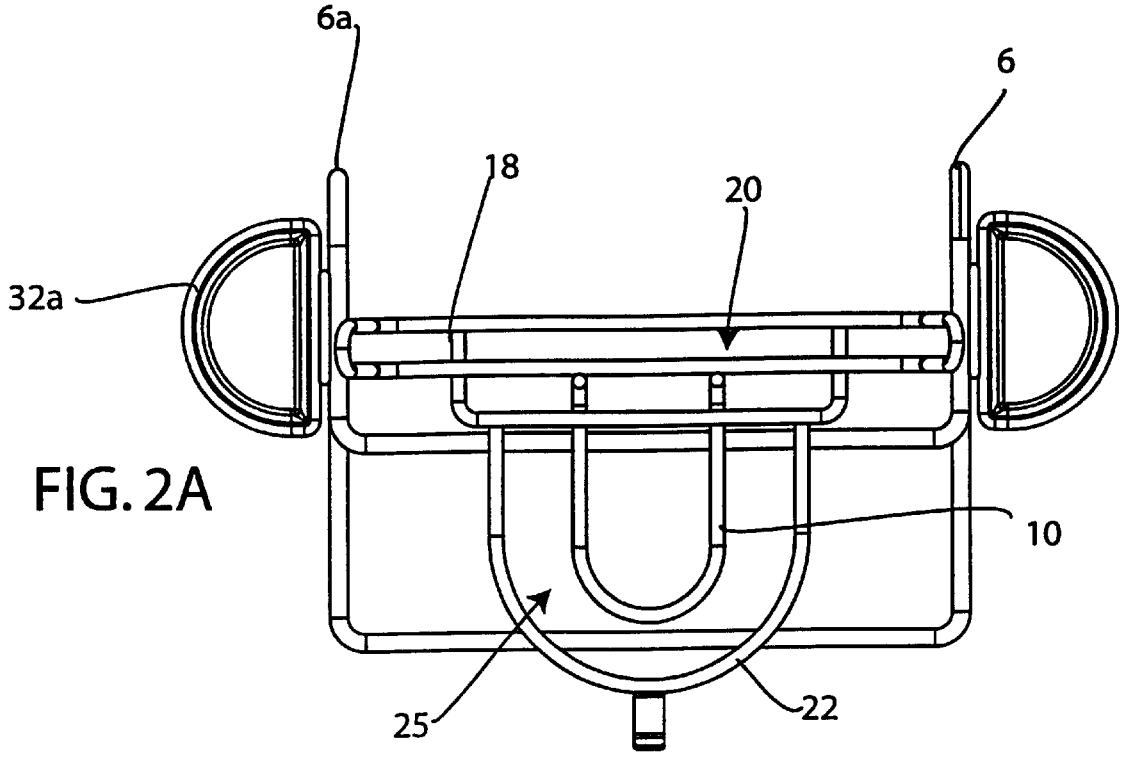
FIG. 2A is a top view of the invention.
Figure 2B:
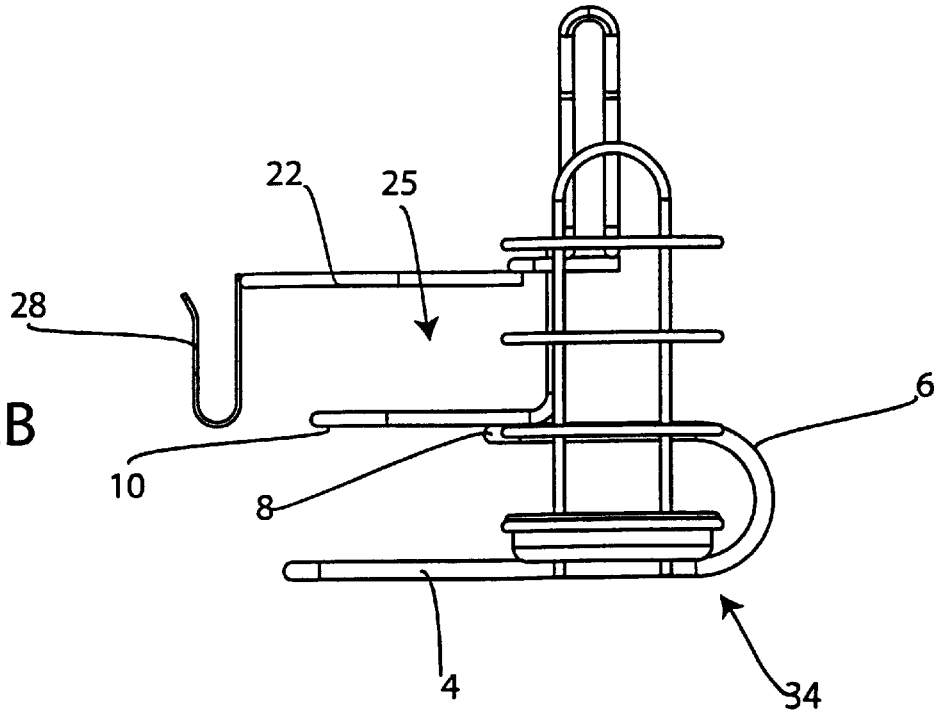
FIG. 2B is a side view of the invention.
Figure 3:
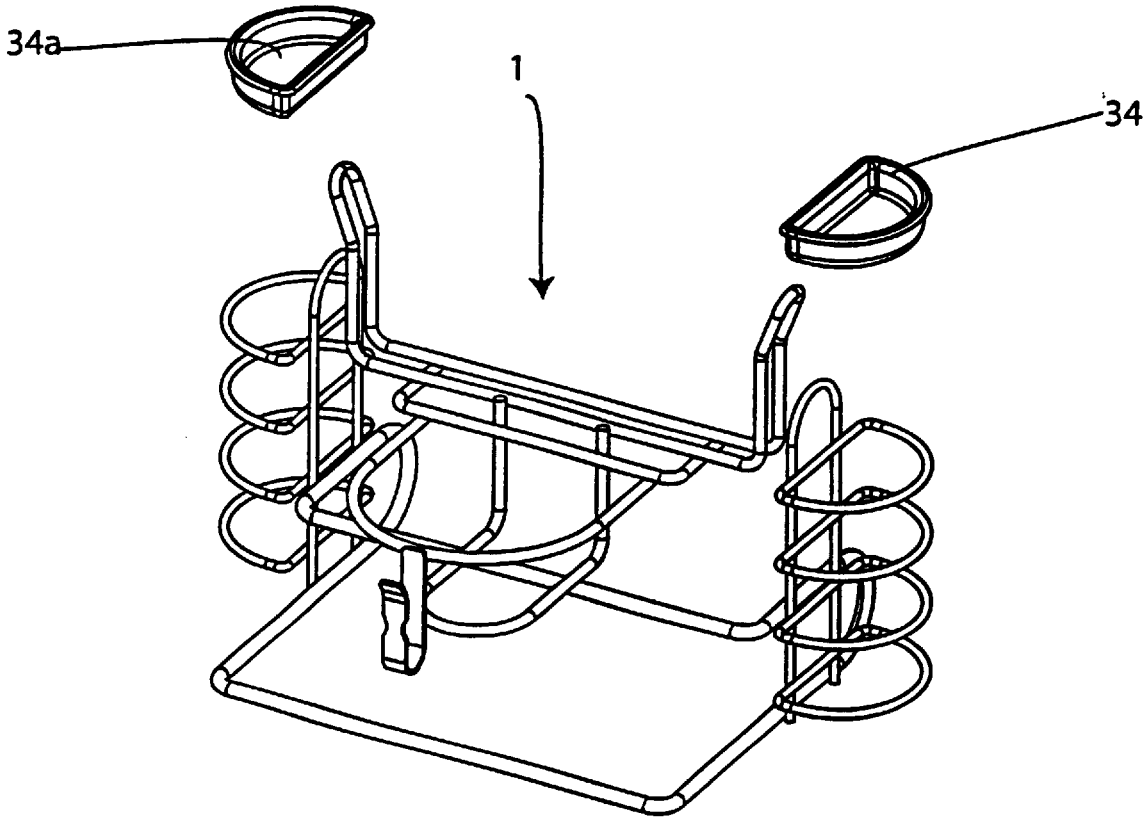
FIG. 3 is a side perspective view of the invention with containers being added.

As shown in FIG. 2A frames 32 and 32A are positioned concentric with each other so that a plurality of elongated objects such as a plurality of pens, pencils, a ruler, an emery board, and scissors can be placed inside while still extending vertically. As shown in FIG. 3, the bottom containers 34 and 34A are set in place on the bottom rung of frames 32 and 32A so to support these elongated objects above a user's desk.

With this design, the first container or container holder is used to hold paper clips, thumb tacks and other smaller ects. The second set of containers or container holders 36 38 are used to hold more elongated objects as described above giving this organizer great flexibility in storing different types of objects.

Accordingly, while one embodiment of the present invention e been shown and described, it is to be understood that many changes and modifications may be made thereunto without departing from the spirit and scope of the invention as defined the appended claims.

What is claimed is:

1. A desktop organizer comprising:

a base;

a first substantially semi-circular wire section coupled to said base;

an upward extending support frame coupled to said first substantially semi-circular wire section;

a picture frame holder coupled to said upward extending support frame;

a card holder formed by a U-shaped wire section coupled to and extending out substantially horizontally in front of said picture frame holder and said upward extending support frame;

a second substantially semi-circular wire section coupled to said U-shaped wire section, which extends substantially horizontally out from said U-shaped wire section and thereby forms a first container holder with said first substantially semi-circular wire section; and a plurality of substantially U-shaped vertically extending support columns coupled to said base; and a plurality of substantially semi-circular shaped closed frames coupled to said plurality of substantially U-shaped vertically extending support columns wherein said closed frames form a second and a third container holder.

2. The organizer as in claim 1, further comprising a clip coupled to said second substantially semi-circular wire frame.

3. The organizer as in claim 1, wherein said base is made out of wire.

4. The organizer as in claim 1, wherein said base comprises a first region that is substantially U-shaped bounding a first plane, a second region that comprises two substantially U-shaped supports extending substantially vertically up and a third region formed by a substantially U-shaped wire extending substantially horizontally forming, a second plane that extends above and substantially parallel to said first plane.

5. The organizer as in claim 1, further comprising a first container which can be slidably engaged into said first container holder, and a second container which can be slidably engaged into said second container holder.

6. The organizer as in claim 5, wherein said second container and said third container each comprise a flange to secure said second container and said third container into said second container holder and said third container holder.

* * * * *